US007330002B2

(12) United States Patent
Joung

(10) Patent No.: US 7,330,002 B2
(45) Date of Patent: Feb. 12, 2008

(54) CIRCUIT FOR CONTROLLING LED WITH TEMPERATURE COMPENSATION

(75) Inventor: Il Kweon Joung, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 11/515,827

(22) Filed: Sep. 6, 2006

(65) Prior Publication Data

US 2007/0057902 A1 Mar. 15, 2007

(30) Foreign Application Priority Data

Sep. 9, 2005 (KR) ..... 10-2005-0084312

(51) Int. Cl.
*G05F 1/00* (2006.01)

(52) U.S. Cl. ..... 315/309; 315/307; 315/291; 315/246; 345/82; 345/102

(58) Field of Classification Search ..... 315/209 R, 315/219, 246, 276, 291, 307–309; 345/82, 345/94, 102

See application file for complete search history.

(56) References Cited

U.S. PATENT DOCUMENTS

| | | | | |
|---|---|---|---|---|
| 6,400,101 | B1 * | 6/2002 | Biebl et al. | 315/291 |
| 6,753,661 | B2 | 6/2004 | Muthu et al. | 315/307 |
| 6,836,081 | B2 * | 12/2004 | Swanson et al. | 315/307 |
| 6,956,337 | B2 * | 10/2005 | Kemper | 315/307 |
| 7,119,503 | B2 * | 10/2006 | Kemper | 315/309 |
| 2005/0030267 | A1 * | 2/2005 | Tanghe et al. | 345/82 |
| 2005/0184946 | A1 | 8/2005 | Pyoun et al. | 345/94 |
| 2005/0190171 | A1 * | 9/2005 | Jang et al. | 345/204 |
| 2006/0017404 | A1 * | 1/2006 | Jang | 315/291 |
| 2006/0022616 | A1 * | 2/2006 | Furukawa et al. | 315/309 |
| 2007/0013322 | A1 * | 1/2007 | Tripathi et al. | 315/291 |

FOREIGN PATENT DOCUMENTS

| | | |
|---|---|---|
| KR | 10-2005-0021004 | 3/2005 |
| KR | 10-2005-0083003 | 8/2005 |

OTHER PUBLICATIONS

Korean Office Action issued in corresponding Korean Patent Application No. KR 10-2005-0084312, dated Nov. 1, 2006.

* cited by examiner

*Primary Examiner*—Douglas W. Owens
*Assistant Examiner*—Tung X Le
(74) *Attorney, Agent, or Firm*—McDermott Will & Emery LLP

(57) ABSTRACT

A circuit for controlling an LED with temperature compensation is employed in the LED-based system. The circuit of the invention linearly controls luminance and color of the LED according to temperature change and more precisely compensates for temperature-related variations in LED properties. Also, the circuit saves the cost of the product due to no requirement of a microprocessor. In the circuit, a waveform generator generates a sawtooth wave for Pulse Width Modulation (PWM) control. A temperature detector detects a voltage via a resistance value which is linearly variable according to changes in an ambient temperature. A PWM controller compares the sawtooth wave from the wave generator with the detection voltage from the temperature detector and generates a PWM voltage having a duty determined by the comparison result.

8 Claims, 9 Drawing Sheets

CIRCUIT FOR CONTROLLING LED WITH TEMPERATURE COMPENSATION

CLAIM OF PRIORITY

This application claims the benefit of Korean Patent Application No. 2005-84312 filed on Sep. 9, 2005 in the Korean Intellectual Property Office, the disclosure of which is incorporated herein by reference.

BACKGROUND OF THE INVENTION

1. Field of the Invention

The present invention relates to a circuit for controlling a Light Emitting Diode (LED) which is employed in a backlight system or a lighting system. More particularly, the present invention relates to a circuit for controlling an LED which can linearly control luminance and color according to changes in an ambient temperature to more precisely compensate for temperature-induced variations in LED properties, and save the cost of the product due to no requirement of a microprocessor.

2. Description of the Related Art

In general, a Cold Cathode Fluorescent Lamp (CCFL) is largely employed in a Liquid Crystal Display (LCD) and other back light systems for electronic display. However, attempts have been made to substitute a light emitting diode (LED) for the CCFL in the backlight system for various reasons. That is, with the LED employed, a color gamut is expanded and a white point can be controlled through color control. Also, advantageously, the LED is devoid of mercury and thus environment-friendly.

The LED backlight system combines red (R), green (G) and blue (B) light into white light to use as a light source. The R, G, B LEDs for use in the backlight system vary in their properties depending on a voltage applied, ambient temperature and operation time. Also, the R, G and B LEDs differ in their own characteristics considerably.

Accordingly, in the LED-based backlight system or all systems using the LED as a light source, it is necessary to control luminance and color to be uniform regardless of environmental changes such as ambient temperature, aging effects of the LED and differences in LED properties.

FIG. 1 is a block diagram illustrating a conventional light emitting control device.

Referring to FIG. 1, the conventional light emitting device 10 detects a forward voltage Vf of an LED device 1, estimates an ambient temperature Ta from the detected forward voltage Vf, derives an optimal feedback point of a driving current of the LED device 1 and controls a light emitting amount of the LED device 1.

The conventional light emitting control device 10 includes an A/D converter 12, a feedback point decider 14, a temperature properties memory 16, a PWM controller 27 and a PWM circuit 28. The A/D converter 12 detects the forward voltage Vf of the LED device 1 and converts it into a digital signal. The feedback point decider 14 estimates the ambient temperature Ta of the LED device 1 via the forward voltage Vf from the A/D converter 12 and decides the optimum feedback point of the driving current of the LED device 1 based on the ambient temperature Ta. The temperature properties memory 16 memorizes a Vf-Ta table 17 for correlating the forward voltage Vf of the LED device 1 with the ambient temperature Ta and a Ta-Ifmax table 19 for correlating the ambient temperature Ta with a maximum allowable current Ifmax. The PWM controller 27 performs PWM control of the LED device 1 in response to decision by the feedback point decider 14. The PWM circuit 28 drives the LED device by PWM under the control of the PWM controller 27.

Here, the Vf-Ta table 17 and Ta-Ifmax table 19 are preset based on temperature properties of the LED device 1 described later. The feedback point decider 14 refers to a table of the temperature properties of the LED device 1 memorized by the temperature properties memory 16 to decide the ambient temperature Ta and the driving current.

Furthermore, temperature properties of the LED device 1 vary with the types of the LED device 1. Accordingly the Vf-Ta table 17 and the Ta-Ifmax table 19 are specified by the type of the LED device 1.

A temperature calculator 13 of the feedback point decider 14 refers to the Vf-Ta table 17 memorized by the temperature properties memory 16 to derive the ambient temperature Ta via the detected forward voltage Vf. The driving current decider 15 of the feedback point decider 14 decides the feedback point of the driving current of the LED device 1 and then a control value of the driving current so that the ambient temperature Ta calculated by the temperature calculator 13 falls within a range of an ambient temperature for driving the LED device 1 and a desired light emitting amount of the LED device 1 is achieved.

For example, in a case where the ambient temperature Ta calculated by the temperature calculator 13 is lower than an upper limit of an ambient temperature for driving the LED device 1 and thus luminance of the LED device 1 needs to be further increased, the driving current decider 15 decides the control value so that the driving current is raised. Also, in a case where the ambient temperature Ta approximates an upper limit of an ambient temperature for driving, the driving current decider 15 decides the control value so that the driving current is reduced.

That is, the forward voltage of the LED device 1 is measured according to changes in temperature and current temperature is estimated based on a pre-memorized temperature vs. forward voltage table. Then a maximum allowable current of the LED device 1 is adjusted via a table of the maximum allowable current according to temperature to control the driving voltage of the LED device 1.

However, such a conventional method needs to employ a microprocessor to ensure more precise control, disadvantageously increasing production costs.

FIG. 2 is a configuration diagram illustrating a conventional backlight device.

The conventional backlight device of FIG. 2 includes a power supply 110, light sources 150 and 160, a temperature sensor 250, photo diodes 210 and a controller 180. The power supply 110 is comprised of a plurality of LED drivers 120 to 140 for driving by an alternating current 115. The light sources 150 and 160 are comprised of a plurality of LEDs which are turned on by the drivers 120 to 140 of the power supply 110 to emit light, and supply light into a light guide 170. The temperature sensor 250 senses temperature of the light sources 150 and 160. The photo diodes 210 are disposed in the middle of both sides of the light guide 170 to sense luminance of light. The controller 180 compensates for temperature-related variations in luminance and color based on temperature measured by the temperature sensor 250 through an interface for detection 230 and luminance determined by the photo diode 210.

The conventional backlight device employs both the temperature sensor and the photo sensor. Here, in order to control the LED driver, temperature is measured via the temperature sensor and a light amount of the LED device is measured via the photo sensor to maintain a desired light amount. Such a control is enabled via a microprocessor.

In this case, the respective light amount of R, G and B LEDs is measured through photo sensors equipped with a filter. With the values measured, the R, G and B LEDs are controlled respectively so as to maintain the light amount which is perceived and targeted by the microprocessor. Also, temperature is measured via the temperature sensor attached to a heat sink to compensate for variations in LED properties according to the measured temperature.

However, like the conventional method of FIG. 1, this conventional method of FIG. 2 is disadvantageous in terms of manufacturing costs for the system.

SUMMARY OF THE INVENTION

The present invention has been made to solve the foregoing problems of the prior art and therefore an object according to certain embodiments of the present invention is to provide a circuit for controlling a light emitting diode (LED) which is employed in a backlight system and a lighting system to linearly control luminance and color linearly according to an ambient temperature, thereby more precisely compensating for temperature-related variations in LED properties and saving the cost of the product due to no requirement of a microprocessor.

According to an aspect of the invention for realizing the object, there is provided a circuit for controlling a Light Emitting Diode (LED) with temperature compensation including a waveform generator for generating a sawtooth wave for Pulse Width Modulation (PWM) control; a temperature detector for detecting a voltage via a resistance value which is linearly variable according to changes in an ambient temperature; and a PWM controller for comparing the sawtooth wave from the wave generator with the detection voltage from the temperature detector and generating a PWM voltage having a duty determined by the comparison result.

The circuit further includes a driver for driving an LED backlight in response to the PWM voltage from the PWM controller.

The temperature detector includes a temperature detection circuit for dividing a dimming voltage via the variable resistance value to output the detection voltage; and a comparator for outputting a difference voltage between the detection voltage from the temperature detection circuit and the dimming voltage.

The temperature detection circuit includes first and second resistors connected in series between a dimming voltage terminal and a ground terminal; a first temperature detection device having a resistance value corresponding to an ambient temperature, the first temperature detection device connected in parallel to the first or second resistor; and a plurality of temperature detection devices each having a resistance value corresponding to an ambient temperature, the temperature detection devices connected in parallel to the first temperature detection device and in series with one another.

The temperature detection circuit includes first and second resistors connected in series with each other between a dimming voltage terminal and a ground terminal; a first temperature detection device having a resistance value corresponding to an ambient temperature, the first temperature detection device connected in parallel to the second resistor; and second and third temperature detection devices each having a resistance value corresponding to an ambient temperature, the second and third temperature detection devices connected in parallel to the first temperature detection device and in series with each other.

Also, the temperature detection circuit includes first and second resistors connected in series with each other between a dimming voltage terminal and a ground terminal; a first temperature detection device having a resistance value corresponding to an ambient temperature, the first temperature detection device connected in parallel to the second resistor; and second and third temperature detection devices each having a resistance value corresponding to an ambient temperature, the second and third temperature detection devices connected in parallel to the first temperature detection device and in series with each other.

The PWM controller includes an inversion input terminal for receiving the sawtooth wave from the waveform generator; a non-inversion input terminal for receiving the detection voltage detected by the temperature detector; and an output terminal for comparing the sawtooth wave from the inversion input terminal with the detection voltage from the non-inversion input terminal and outputting a PWM voltage having a duty determined by the comparison result.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Figure 1:
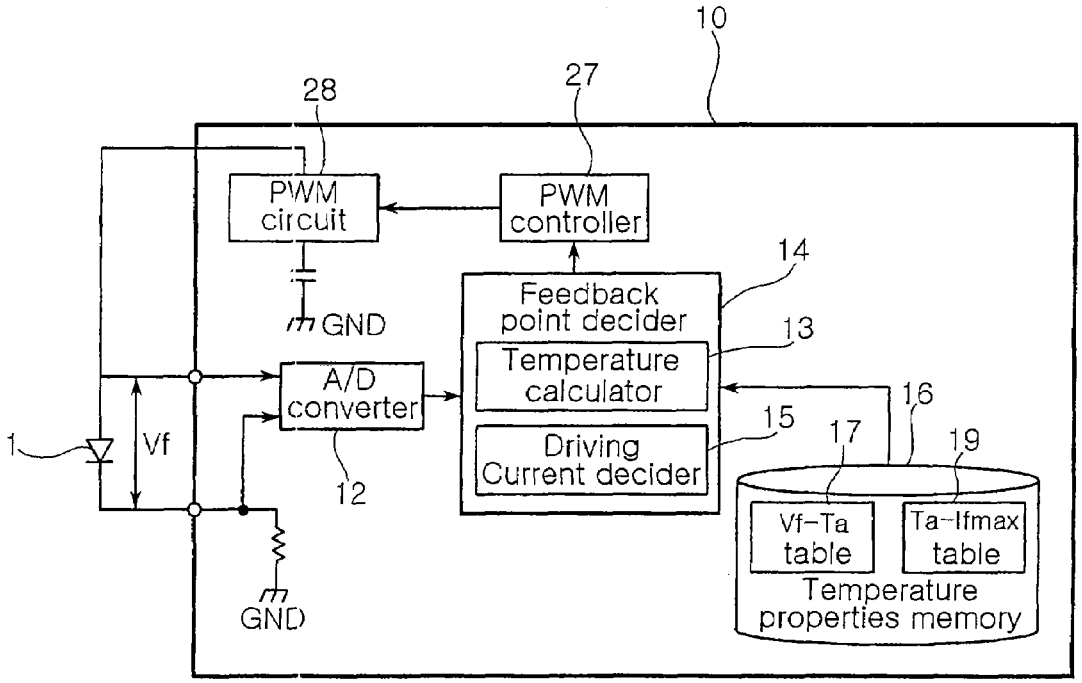
Prior Art FIG. 1
FIG. 1 is a block diagram illustrating a conventional light emitting control device.
Figure 2:
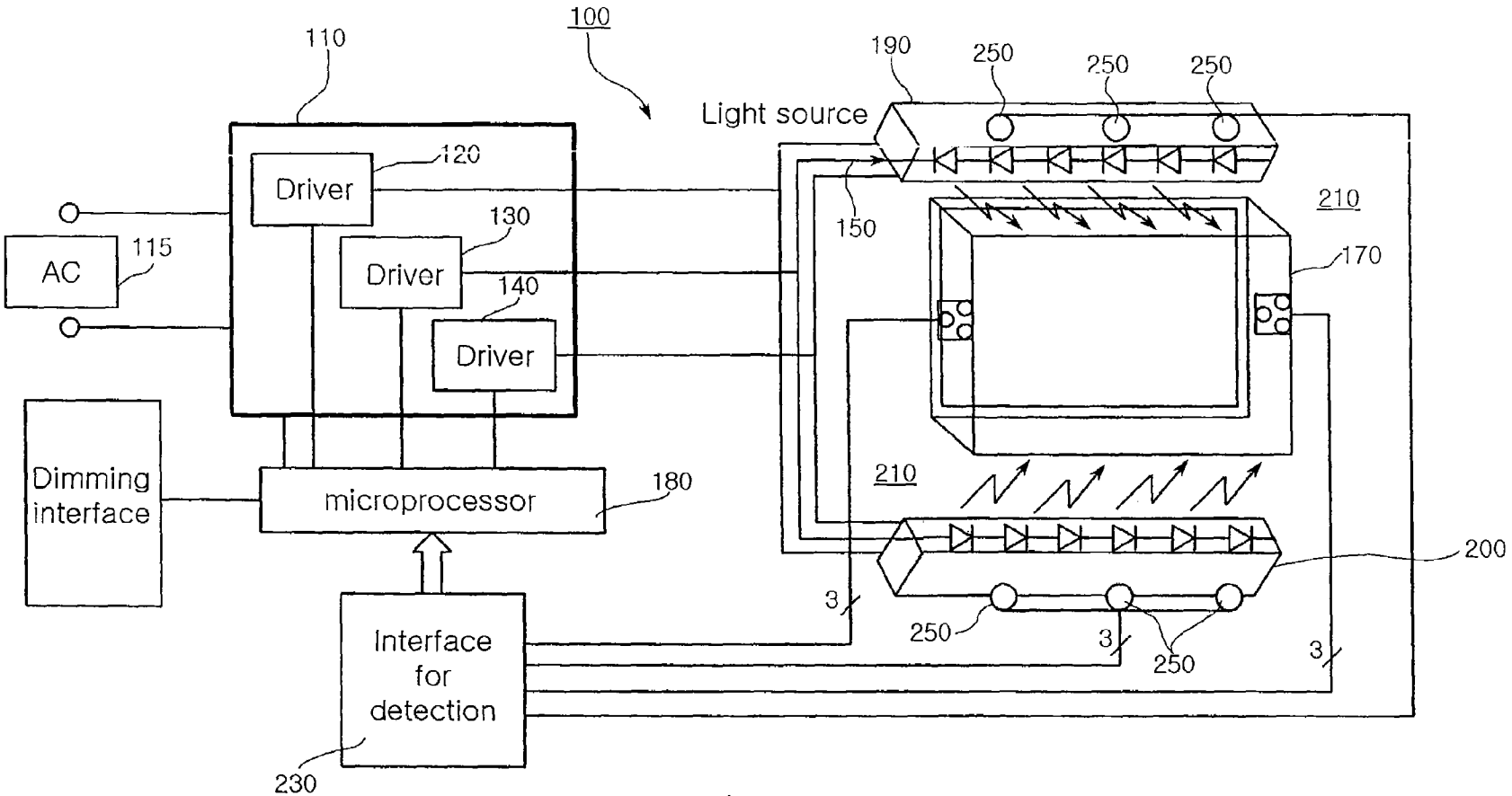
Prior Art FIG. 2
FIG. 2 is a configuration diagram illustrating a conventional back light device.

Preferred embodiments of the present invention will now be described in detail with reference to the accompanying drawings, in which the same reference numerals are used throughout the different drawings to designate the same or similar components.

Figure 3:
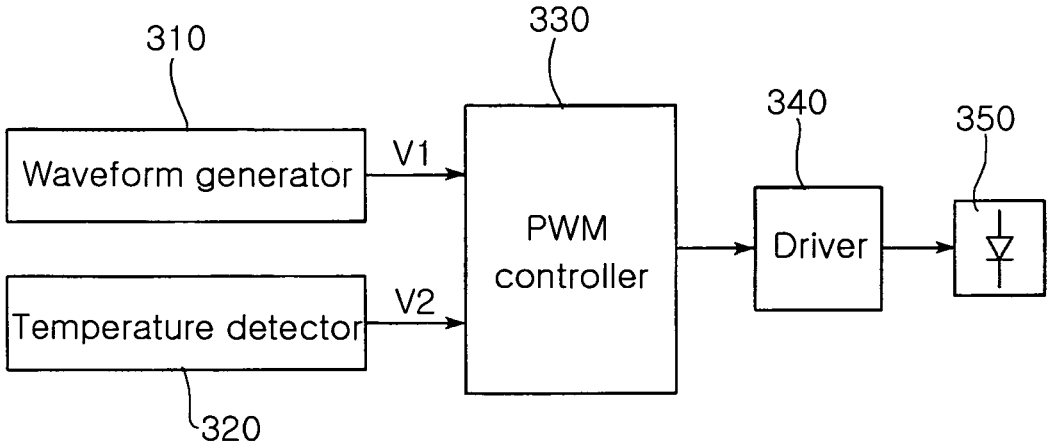
FIG. 3 is a circuit diagram for controlling LED driving according to the invention.

FIG. 3 is a circuit diagram for controlling a light emitting diode (LED) according to the invention.

Referring to FIG. 3, the circuit for controlling the LED includes a waveform generator 310, a temperature detector 320, a PWM controller 330 and a driver 340. The waveform generator 310 generates a sawtooth wave V1 for Pulse Width Modulation (PWM) control. The temperature detector 320 detects a voltage V2 via a resistance value which is linearly variable according to changes in an ambient temperature. The PWM controller 330 compares the sawtooth wave V1 from the wave generator with the detection voltage V2 from the temperature detector and generates a PWM voltage Vpwm having a duty determined by the comparison result. The driver drives an LED backlight in response to the PWM voltage Vpwm from the PWM controller 330.

Here, the sawtooth wave V1 is exemplified by a wave having a frequency of about 1 KHz and a voltage of about 2.5V to 3.3V.

Figure 4A:
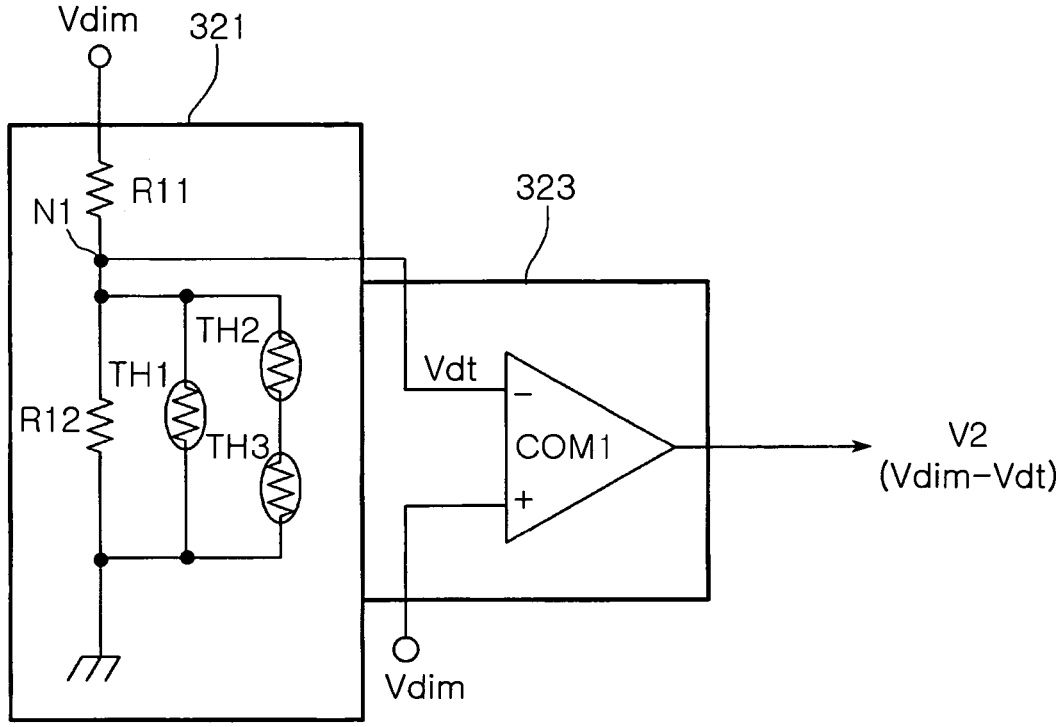
FIG. 4*a* is a circuit diagram illustrating an embodiment of a temperature detector of FIG. 3.

Referring to FIGS. 3 and 4*a*, the temperature detection circuit 320 includes a temperature detection circuit 321 and a comparator 323. The temperature detection circuit divides a dimming voltage Vdim via the variable resistance value to output the detection voltage Vdt. In this case, the resistance value is variable according to changes in the ambient temperature. The comparator 323 outputs a difference voltage between the detection voltage Vdt from the temperature detection circuit 321 and the dimming voltage Vdim.

Figure 5A:
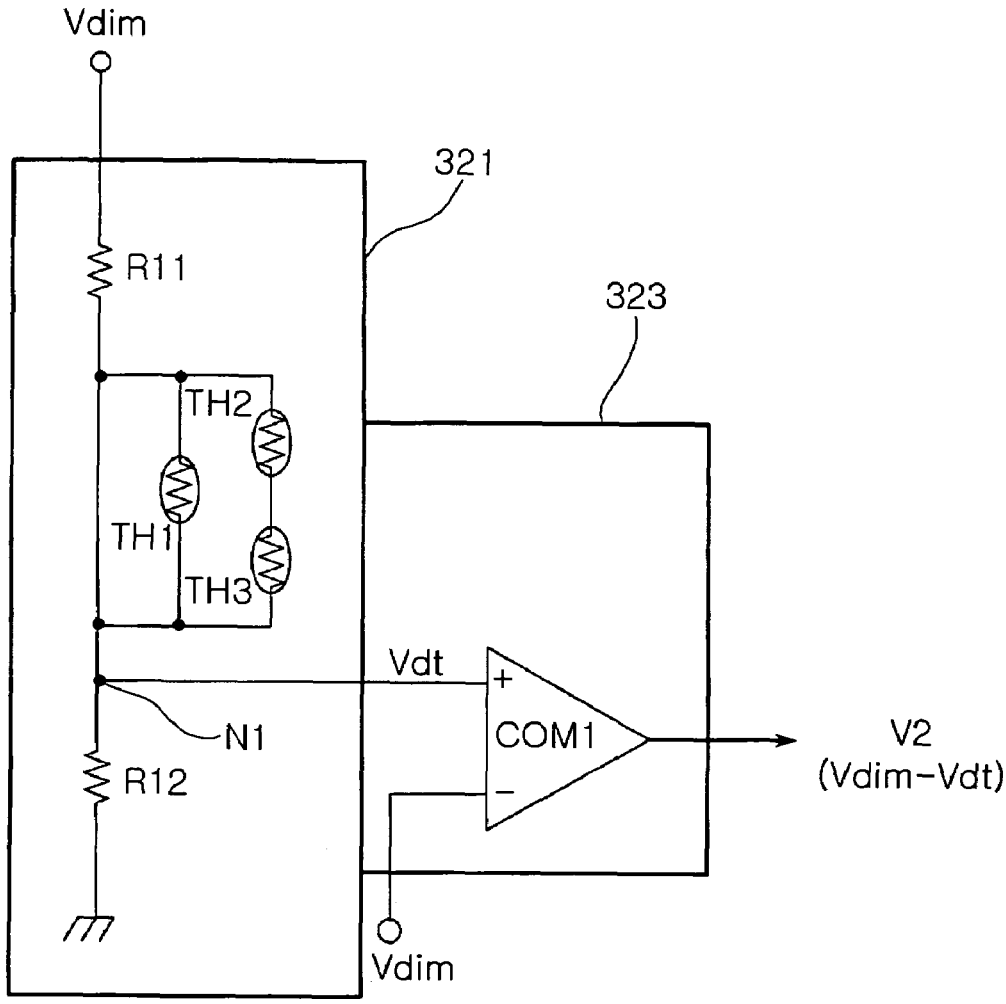
FIG. 5*a* is a circuit diagram illustrating another embodiment of the temperature detector of FIG. 3.

Referring to FIGS. 4*a* and 5*a*, the temperature detection circuit 321 includes first and second resistors R11 and R12, a first temperature detection device and second and third temperature detection devices TH2 and TH3. The first and second resistors R11 and R12 are connected in series between a dimming voltage Vdim and a ground terminal. The first temperature detection device TH1 has a resistance value corresponding to an ambient temperature. The first temperature detection device TH1 is connected in parallel to the first or second resistor R11 or R12. The second and third temperature detection devices TH2 and TH3 each have a resistance value corresponding to the ambient temperature. The second and third temperature detection devices TH2 and TH3 are connected in parallel to the first temperature detection device TH1 and in series with each other.

Here, the first to third temperature detection devices TH1 to TH3 may adopt a negative temperature coefficient (NTC) thermistor whose resistance value decreases with rising temperature or a positive temperature coefficient (PTC) thermistor whose resistance value increases with rising temperature. FIGS. 4 and 5 employ the NTC thermistor, respectively.

Also, out of the first to third temperature detection devices TH1 to TH3 for detecting temperature, the second and third temperature detection devices TH2 to TH3 are additionally structured to vary the resistance value corresponding to temperature properties. Moreover, the second resistor R12 is connected in parallel to the first temperature detection device TH1 to impart linearity to nonlinear characteristics of the thermistor.

Figure 4B:
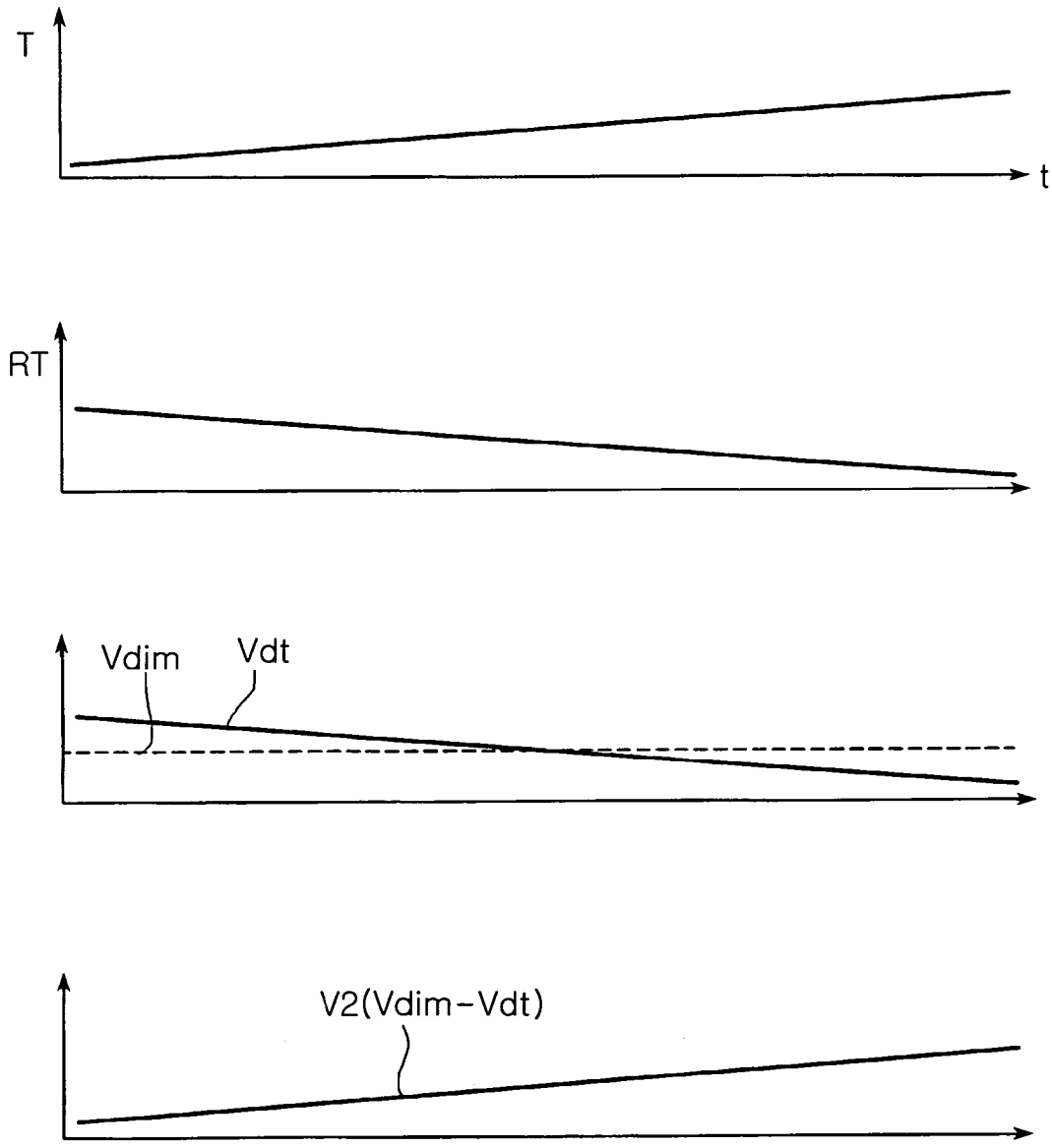
FIG. 4*b* is a waveform diagram for explaining the operation of the temperature detector of FIG. 4*a;*

FIG. 4*a* is a circuit diagram illustrating an embodiment of the temperature detector of FIG. 3, and FIG. 4*b* is a waveform diagram for explaining the operation of the temperature detector of FIG. 4*a*.

Referring to FIG. 4*a*, the temperature detection circuit includes first and second resistors R11 and R12, a first temperature detection device TH1, second and third temperature detection devices TH2 and TH3. The first and second resistors R11 and R12 are connected in series with each other between the dimming voltage Vdim terminal and a ground terminal. The first temperature detection device TH1 is connected in parallel to the second resistor R12 and has a resistance value corresponding to an ambient temperature. The second and third temperature detection devices TH2 and TH3 each have a resistance value corresponding to the ambient temperature. The second and third temperature detection devices TH2 and TH3 are connected in parallel to the first temperature detection device TH1 and in series with each other.

Referring to FIG. 4*a*, the comparator 323 includes an inversion input terminal, a non-inversion input terminal and an output terminal. The inversion input terminal receives the voltage Vdt detected at a connecting node of the first and second resistors R11 and R12. The non-inversion input terminal receives the dimming voltage Vdim. The output terminal outputs a difference voltage between the detection voltage Vdt from the inversion input terminal and the dimming voltage Vdim from the non-inversion input terminal.

In FIG. 4*b*, T denotes an ambient temperature, RT denotes a total voltage of the second resistor R12 and the first to third temperature detection devices TH1 to TH3, Vdt denotes a detection voltage and V2(Vdim−Vdt) denotes a temperature detection voltage.

Figure 5B:
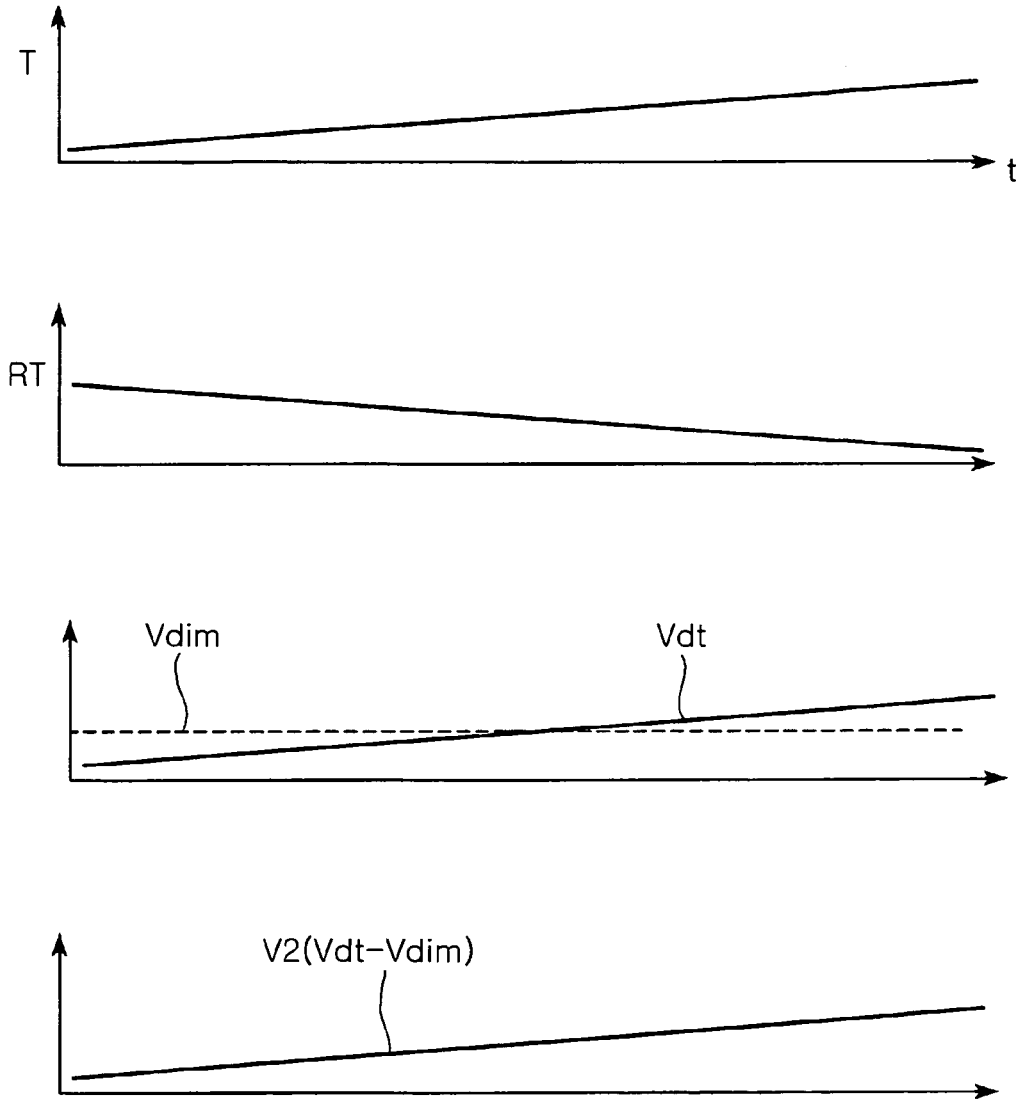
FIG. 5*b* is a waveform diagram for explaining the operation of the temperature detector of FIG. 5*a;*

FIG. 5*a* is a circuit diagram illustrating another embodiment of the temperature detector of FIG. 3 and FIG. 5*b* is a waveform diagram for explaining the operation of the temperature detector of FIG. 5*a*.

Referring to FIG. 5*a*, the temperature detection circuit 321 includes first and second resistors R11 and R12, a first temperature detection device TH1 and second and third temperature detection devices TH2 and TH3. The first and second resistors R11 and R12 are connected in series between the dimming voltage Vdim and a ground terminal. The first temperature detection device TH1 is connected in parallel to the first resistor R11 and has a resistance value corresponding to an ambient temperature. The second and third temperature detection devices TH2 and TH3 each have a resistance value corresponding to the ambient temperature. The second and third temperature detection devices TH2 and TH3 are connected in parallel to the first temperature detection device TH1 and in series with each other.

Referring to FIG. 5*a*, the comparator 323 includes a non-inversion input terminal, an inversion input terminal and a comparator COM1. The non-inversion input terminal receives a voltage Vdt detected at a connecting node of the first and second resistors R11 and R12. The inversion input terminal receives the dimming voltage Vdim. The output terminal outputs the difference voltage of the detected voltage Vdt from the non-inversion input terminal and the dimming voltage Vdim from the inversion input terminal.

In FIG. 5*b*, T denotes an ambient temperature, RT denotes a total resistance of the first resistor R11, and the first to third temperature detection devices TH1 to TH3, Vdt denotes a detection voltage and V2 denotes a temperature detection voltage.

Figure 6:
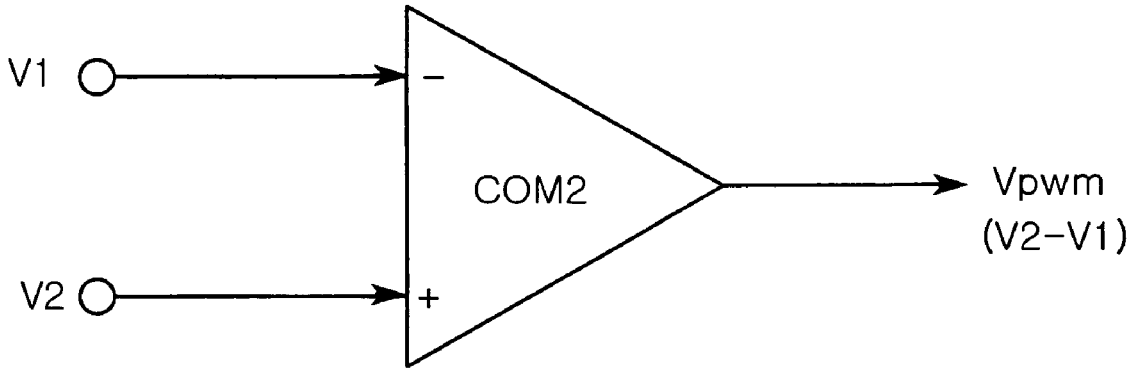
FIG. 6 is a circuit diagram illustrating a PWM controller of FIG. 3.

FIG. 6 is a circuit diagram illustrating the PWM controller of FIG. 3.

Referring to FIG. 6, the PWM controller 330 includes an inversion input terminal, a non-inversion input terminal and an output terminal. The inversion input terminal receives a sawtooth wave V1 from the waveform generator 310. The non-inversion input terminal receives the voltage V2 detected by the temperature detector. The output terminal compares the sawtooth wave V1 from the inversion input terminal with the detection voltage from the non-inversion input terminal and outputting a PWM voltage Vpwm having a duty determined by the comparison result.

Figure 7:
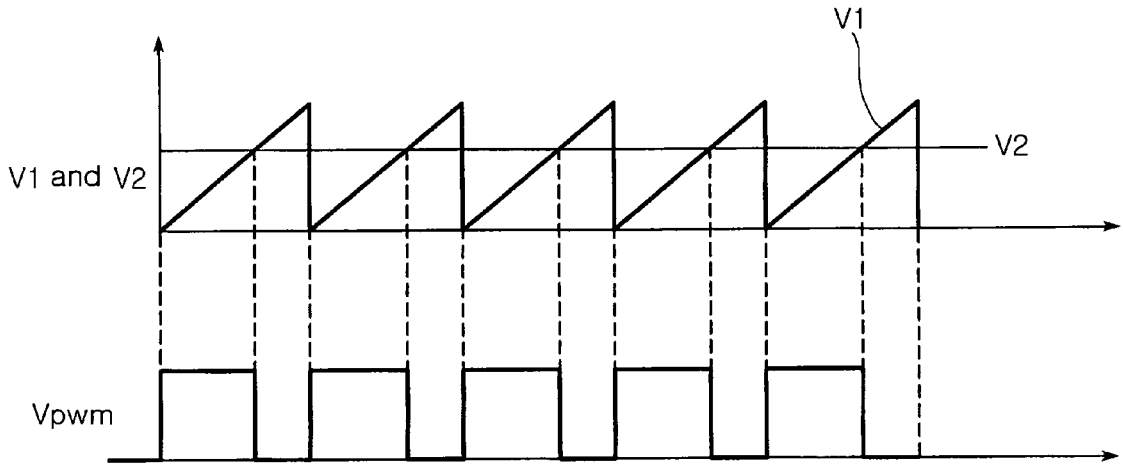
FIG. 7 is a waveform diagram for explaining the operation of the PWM controller of FIG. 6.

FIG. 7 is a waveform diagram for explaining the operation of the PWM controller of FIG. 6.

In FIG. 7, V1 denotes a sawtooth wave generated by the waveform generator 310, V2 denotes a temperature detection voltage detected by the temperature detector 320 and Vpwm denotes a PWM voltage generated by the PWM controller 330.

The operations and effects of the invention will be explained in detain with reference to the accompanying drawings.

A circuit for controlling an LED of the invention is employed in an LED-based system to compensate for temperature-induced variations in LED properties, which will be explained with reference to FIGS. 3 to 7.

Referring to FIG. 3, the waveform generator 310 of the invention generates a sawtooth wave V1 having a frequency of about 1 KHz for PWM control and a voltage having a voltage of about 2.5V to 3.3V.

The temperature detector 320 of the invention detects a voltage V2 corresponding to a resistance value which is linearly variable according to changes in the ambient temperature via a temperature detection device such as a thermister.

Then, the PWM controller 330 of the invention compares the sawtooth wave V1 from the waveform generator 310 with the detection voltage V2 from the temperature detector 320 and generates a PWM voltage having a duty determined by the comparison result.

Subsequently, the driver 340 drives an LED backlight in response to the PWM voltage Vpwm from the PWM controller 330.

Referring to FIGS. 4 and 5, the temperature detector 320 includes the temperature detection circuit 321 and the comparator 323. The temperature detection circuit 321 divides a dimming voltage Vdim via the variable resistance value to output the detection voltage Vdt. Here, the resistance value is variable according to changes in the ambient temperature. The comparator 323 outputs a difference voltage between the detection voltage Vdt from the temperature detection circuit 321 and the dimming voltage Vdim.

As shown in FIGS. 4*a* and 5*a*, in the temperature detection circuit 321, the first and second resistors R11 and R12 connected in series between the dimming voltage Vdim and a ground terminal serve to divide the dimming voltage Vdim. Here, the first temperature detection device TH1 connected in parallel to the first or second resistor R11 or R12 has a resistance value corresponding to the ambient temperature. Accordingly the divided voltage of the dimming voltage Vdim varies with the temperature, thereby enabling detection of the voltage according to changes in the temperature.

Also, the temperature detection devices TH2 and TH3 each have a resistance value corresponding to the ambient temperature. The temperature detection devices TH2 and TH3 are connected in parallel to the first temperature detection device TH1 and in series with each other. Thus, the temperature detection devices TH2 and TH3 linearly detect the voltage in response to changes in the temperature.

A detailed explanation will be given about configuration of the temperature detection circuit 321 with reference to FIGS. 4 and 5.

First, referring to FIG. 4*a*, in the temperature detection circuit 321 of the temperature detector 320 of FIG. 3, the first and second resistors R11 and R12 connected in series between the dimming voltage Vdim and the ground terminal serve to divide the dimming voltage Vdim. Here, the first temperature detection device TH1 is connected in parallel to the second resistor R12, and the second and third temperature detection devices TH2 and TH3 in turn are connected in parallel to the first temperature detection device TH1.

The total resistance RT of the second resistor R12 and the first to third temperature detection device TH1 to TH3 is variable according to the ambient temperature. The dimming voltage Vdim is divided by the total resistance RT to detect the detection voltage Vdt corresponding to the ambient temperature.

In this case, the comparator 323 outputs the difference voltage Vdim−Vdt between the detection voltage Vdt from the temperature detection circuit 321 and the dimming voltage Vdim.

Referring to FIG. 4*b*, with a rise in the ambient temperature T, the total resistance RT of the second resistor R12 and the first to third temperature detection devices TH1 to TH3 is reduced. Here, in a case where the first to third temperature detection devices TH1 to TH3 each are configured as a negative temperature coefficient (NTC) thermistor whose resistance value is inversely proportional to the ambient temperature, a decrease in the total resistance RT gradually reduces the detection voltage Vdt detected by the total resistance RT.

Accordingly, the comparator 323 outputs the gradually increasing difference voltage Vdim−Vdt between the detection voltage Vdt from the inversion input terminal and the dimming voltage Vdim from the non-inversion input terminal.

First, with reference to FIG. 5*a*, in the temperature detection circuit 321 of the temperature detector 320 of FIG. 3, the first and second resistors R11 and R12 connected in series between the dimming voltage Vdim and the ground terminal serve to divide the dimming voltage Vdim. Here, the first temperature detection device TH1 is connected in parallel to the first resistor R11 and the second, and third temperature detection devices TH2 and TH3 in turn are connected in parallel to the first temperature detection device TH1.

Here, the total resistance RT of the first resistor R11, and the first to third temperature detection device TH1 to TH3 is variable according to the ambient temperature. The dimming voltage Vdim is divided by the second resistor R11 to detect the detection voltage Vdt corresponding to the ambient temperature.

In this case, the comparator 323 outputs the difference voltage V2=Vdt−Vdim between the detection voltage Vdt from the temperature detection circuit 321 and the dimming voltage Vdim.

Referring to FIG. 5*b*, in a case where the first to third temperature detection devices TH1 to TH3 each are configured as an NTC thermistor whose resistance value is inversely proportional to the ambient temperature, a rise in the ambient temperature T reduces the total resistance RT of the first resistor R12, and the first to third temperature detection devices TH1 to TH3.

At this time, with a decrease in the total resistance RT, the detection voltage Vdt detected by the second resistor R12 is gradually increased.

Accordingly, the comparator 323 outputs the gradually increasing difference voltage V2=Vdim−Vdt between the detection voltage Vdt from the inversion input terminal and the dimming voltage Vdim from the inversion input terminal.

As described above, with reference to FIGS. 4 and 5, a rise in the ambient temperature leads to an increase in the detection voltage V2 detected according to changes in temperature.

Here, as shown in FIG. 6, in a case where the PWM controller 330 is configured as a comparator COM2, the PWM controller 330 compares a sawtooth wave V1 from the inversion input terminal with the detection voltage V2 from the non-inversion input terminal. Subsequently, as shown in FIG. 7, the PWM controller 330 outputs a high level signal if the detection voltage V2 is higher than the sawtooth wave V1, and a low level signal if vice versa. Accordingly, with an increase in a domain where the detection voltage V2 is higher than the sawtooth wave V1, duty is increased.

The PWM voltage Vpwm determined as just described is outputted from the PWM controller 330.

As set forth above, according to preferred embodiments of the invention, a circuit for controlling an LED is employed in a backlight system or lighting system using the LED. Especially, in the LED-based system, luminance and color of the LED can be controlled linearly according to changes in an ambient temperature, thereby ensuring more precise compensation for temperature-induced variations in LED properties. Also, the invention obviates a need for a microprocessor, thereby reducing the cost of the product.

That is, the circuit of the invention produces uniform color and luminance regardless of variations in LED properties and temperature, and also controls color and luminance despite different characteristics of the R, G, B LEDs. Also, the invention enables a system for linearly controlling color and luminance of the LED in response to variations in LED properties and temperature.

Moreover, the invention allows a cost-efficient system due to no requirement of the microprocessor.

While the present invention has been shown and described in connection with the preferred embodiments, it will be apparent to those skilled in the art that modifications and variations can be made without departing from the spirit and scope of the invention as defined by the appended claims.

What is claimed is:

1. A circuit for controlling a Light Emitting Diode (LED) with temperature compensation comprising:

a waveform generator for generating a sawtooth wave for Pulse Width Modulation (PWM) control;

a temperature detector for detecting a voltage via a resistance value which is linearly variable according to changes in an ambient temperature; and a PWM controller for comparing the sawtooth wave from the wave generator with the detection voltage from the temperature detector and generating a PWM voltage having a duty determined by the comparison result, wherein the temperature detector comprises:

a temperature detection circuit for dividing a dimming voltage via the variable resistance value to output the detection voltage; and a comparator for outputting a difference voltage between the detection voltage from the temperature detection circuit and the dimming voltage.

2. The circuit according to claim 1, further comprising a driver for driving an LED backlight in response to the PWM voltage from the PWM controller.

3. The circuit according to claim 1, wherein the temperature detection circuit comprises:

first and second resistors connected in series between a dimming voltage terminal and a ground terminal;

a first temperature detection device having a resistance value corresponding to an ambient temperature, the first temperature detection device connected in parallel to the first or second resistor; and a plurality of temperature detection devices each having a resistance value corresponding to an ambient temperature, the temperature detection devices connected in parallel to the first temperature detection device and in series with one another.

4. The circuit according to claim 1, wherein the temperature detection circuit comprises:

first and second resistors connected in series with each other between a dimming voltage terminal and a ground terminal;

a first temperature detection device having a resistance value corresponding to an ambient temperature, the first temperature detection device connected in parallel to the second resistor; and second and third temperature detection devices each having a resistance value corresponding to an ambient temperature, the second and third temperature detection devices connected in parallel to the first temperature detection device and in series with each other.

5. The circuit according to claim 4, wherein the comparator comprises:

an inversion input terminal for receiving the voltage detected at a connecting node of the first and second resistors;

a non-inversion input terminal for receiving the dimming voltage; and an output terminal for outputting the difference voltage between the detection voltage from the inversion input terminal and the dimming voltage from the non-inversion input terminal.

6. The circuit according to claim 1, wherein the temperature detection circuit comprises:

first and second resistors connected in series with each other between a dimming voltage terminal and a ground terminal;

a first temperature detection device having a resistance value corresponding to an ambient temperature, the first temperature detection device connected in parallel to the first resistor; and second and third temperature detection devices each having a resistance value corresponding to an ambient temperature, the second and third temperature detection devices connected in parallel to the first temperature detection device and in series with each other.

7. The circuit according to claim 6, wherein the comparator comprises:

a non-inversion input terminal for receiving the detection voltage detected at a connecting node of the first and second resistors;

an inversion input terminal for receiving the dimming voltage; and an output terminal for outputting the difference voltage between the detected voltage from the non-inversion input terminal and the dimming voltage from the inversion input terminal.

8. The circuit according to claim 1, wherein the PWM controller comprises:

an inversion input terminal for receiving the sawtooth wave from the waveform generator;

a non-inversion input terminal for receiving the detection voltage detected by the temperature detector; and an output terminal for comparing the sawtooth wave from the inversion input terminal with the detection voltage from the non-inversion input terminal.

* * * * *